US008219237B2

(12) United States Patent
Schweizer

(10) Patent No.: US 8,219,237 B2
(45) Date of Patent: Jul. 10, 2012

(54) METHOD AND SEWING MACHINE TO FORM SEWING PATTERNS WITH ADJUSTABLE STITCH WIDTH

(75) Inventor: Manfred Schweizer, Steckborn (CH)

(73) Assignee: BERNINA International AG, Steckborn (CH)

( * ) Notice: Subject to any disclaimer, the term of this patent is extended or adjusted under 35 U.S.C. 154(b) by 913 days.

(21) Appl. No.: 11/780,532

(22) Filed: Jul. 20, 2007

(65) Prior Publication Data

US 2008/0022910 A1 Jan. 31, 2008

(30) Foreign Application Priority Data

Jul. 25, 2006 (CH) ..... 1199/06

(51) Int. Cl.
*D05C 5/02* (2006.01)
*D05B 19/00* (2006.01)

(52) U.S. Cl. ..... 700/138; 112/470.01

(58) Field of Classification Search ..... 700/136, 700/137, 138; 112/470.01, 470.02, 84, 102.5
See application file for complete search history.

(56) References Cited

U.S. PATENT DOCUMENTS

| | | | | |
|---|---|---|---|---|
| 4,849,902 | A * | 7/1989 | Yokoe et al. | 700/138 |
| 4,862,816 | A * | 9/1989 | Hanyu et al. | 112/456 |
| 4,942,836 | A * | 7/1990 | Sano et al. | 112/445 |
| 4,982,674 | A * | 1/1991 | Hayakawa | 700/138 |
| 5,035,193 | A | 7/1991 | Hanyu | |
| 5,189,622 | A * | 2/1993 | Hayakawa et al. | 700/138 |
| 5,592,891 | A * | 1/1997 | Muto | 112/475.19 |
| 6,123,040 | A * | 9/2000 | Hayakawa et al. | 112/445 |
| 6,247,420 | B1 * | 6/2001 | Chan et al. | 112/475.19 |
| 2007/0088452 | A1 * | 4/2007 | Suzuki et al. | 700/138 |

* cited by examiner

*Primary Examiner* — Danny Worrell
(74) *Attorney, Agent, or Firm* — Volpe and Koenig, P.C.

(57) ABSTRACT

A method and a sewing machine are provided to form sewing patterns allowing the stitching width to be changed during sewing for a flexible adjustment of parameters of the sewing pattern. In particular the stitch length a can be changed without changing the exterior design of the sewing pattern.

9 Claims, 2 Drawing Sheets

METHOD AND SEWING MACHINE TO FORM SEWING PATTERNS WITH ADJUSTABLE STITCH WIDTH

CROSS-REFERENCE TO RELATED APPLICATIONS

This application claims the benefit of Swiss Patent Appln. No. 01199/06, filed Jul. 25, 2006, which is incorporated herein by reference as if fully set forth.

BACKGROUND

The Invention is directed to a method and a sewing machine to form sewing patterns with an adjustable stitch width.

In the context of sewing and embroidery machines the term "tapering" means the reduction or enlargement of the stitch width of a stitching pattern during the sewing process. Through tapering, sewing patterns can be created that converge to a tip or widen.

From U.S. Pat. No. 5,035,193 a sewing machine is known, in which tapes with a predetermined width that are strung together can be created via zigzag-stitches. The transfer areas between the two adjacent tape sections are created by predetermined stitch patterns with reducing and widening stitch widths. The sewing patterns are each stored by values of the amplitude of the sewing needle perpendicular to the sewing direction and by the drive values of the sewing material. The lifting of the pressure foot is detected by a micro-switch and serves as an indicator for changing to the respective next pattern of a sewing pattern stored in a sequence. In this manner, edged as well as rounded corners can be sewn.

The possibility to create patterns is limited in this sewing machine.

SUMMARY

The object of the present invention is to provide a sewing machine and a method to form sewing patterns with a stitch width to be adjustable during the sewing process.

This object is attained in a method and a sewing machine to form sewing patterns which includes the features of the invention.

The sewing machine according to the invention and the method according to the invention allow a wide range of design flexibility during tapering and/or the production of seams or patterns with an adjustable stitch width. The type of change of the stitch width during the sewing process can be determined by the user. Predetermined settings can be selected and/or parameters can be adjusted. In an advantageous embodiment of the invention, the design of a seam to be created can be predetermined, e.g., by predetermining the lateral edge of a seam to be created via graphic input means or defined as functions.

Frequently used forms and/or functions, such as e.g., linearly conjoining to a tip or a stump or linearly widening edging lines of a seam can preferably be selected via appropriate graphic selection menus on a tough-sensitive monitor. Here, various parameters may be predetermined. Such parameters are, e.g., the opening angle defined by the legs and/or limiting edges, the maximum and if applicable minimum stitch width, the stitch length and/or stitch width, the relative or absolute location of the apexes and the leg ends as well as the length of the pattern.

When entering the parameters, the control checks if based on the already entered data other parameters can be calculated. When this is the case the respective values are automatically updated. E.g., the length of the pattern can be calculated from the opening angle, the location of the apex, and the predetermined maximum width of the seam.

Samples with increasing and reducing stitch widths as well as sections with a constant stitch width can be arbitrarily combined with each other and collected in pattern groups. In an advantageous embodiment of the invention, individual patterns or pattern groups can be detected and saved, e.g., during their creation. The detection and storage may also occur in a simulation mode, with a stitch formation e.g. being hindered by decoupling the needle rod from the needle drive.

In an alternative variant of the control software, which may e.g., be used for creating band sections aligned to each other to miter, the individual band sections are divided into three areas. The first part and the last part form the inclines, to a tip tapering ends of the respective sections. They can be defined by parameters, as already described. The central area has a constant stitch width and represents the connection piece between the two end sections. When recording, only the length of the central part is detected, because the end pieces are already defined and/or have been calculated based on the predetermined parameters.

Data can be stored either for individual band sections or for an entire sequence of band sections, allowing a simple reproduction of such patterns or pattern sequences on the sewing material.

When sewing, one pattern or one pattern sequence is sewn (preferably until the next necessary change of the sewing direction). Points at which a change of the alignment of the sewing material is necessary, may e.g., be determined by choosing the pattern to be sewn. Alternatively, e.g., the points at which the seam tapers to a tip can be interpreted as such a potential turning point. Prior to reaching these points the transport speed is reduced. In the possible rotary points themselves, the sewing needle is pierced into the sewing material and the transport device is stopped. If the sewing machine comprises a motorized, adjustable material pressure rod, the pressure foot may be slightly raised simultaneous to the rotation of the sewing material.

The sewing machine may comprise an auxiliary device for aligning the sewing material, e.g., when the end of the band section is reached, which shows the sewing direction for the subsequent band section via a light strip projected on the sewing material.

Furthermore, the sewing machine may comprise means, which e.g., detect the actual material movement during the sewing process and, when the transportation device for the sewing material has been appropriately provided, control the material transport such that the saved pattern sequences are reproduced as precisely as possible. Alternative to a transportation device with material sliders, which based on the material slippage can lead to an imprecise reproduction of patterns during transportation, other devices may also be provided, such as e.g., embroidery frames for displacing the sewing material in one or more directions.

A change of the stitch length does not lead to a change of the length of the sewing pattern. The stitch length and the length measurement of the stitching pattern to be created can therefore be predetermined or scaled independent from each other. If, for example in a seam tapering to a tip the last stitching site is not at the predetermined tip position, additionally an end-stitch may be performed, with the control using e.g., a reduced value for the material drive such that the last stitch width exactly coincides with the target position at the tip. Alternatively, the predetermined stitch length can be adjusted by the control to the length of the pattern to be created such that the last stitching site exactly coincides with the predetermined position of the tip. In another alternative, the end stitch can be arranged without any additional material drive such that it shows only a minimum off-set in the sewing direction in reference to the predetermined target end position predetermined by the pattern to be created.

Thanks to multiple possible influences of parameters, seams or hems can easily be created with arbitrary variations of the stitch width.

BRIEF DESCRIPTION OF THE DRAWINGS

In the following the invention is explained in greater detail using the drawing figures. Shown are.

DETAILED DESCRIPTION OF THE PREFERRED EMBODIMENTS

Figure 1:
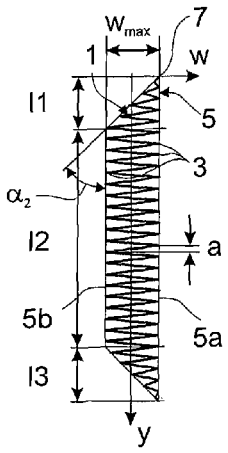
FIG. 1 is a view of a first sewing pattern in the form of a seam section having a constant width with symmetrically embodied tips at both sides with respect to the sewing direction and with a first stitch length.

FIG. 1 shows a first sewing pattern, which has been made based on a simple zigzag-stitch with a constant drive length as a sewing pattern. The sewing thread 1 forms a zigzag-line, with the stitching site 3 in the sewing material being arranged along a trapezoidal enveloping curve 5. The base and its opposite side of the trapezoid extend parallel to the sewing direction y, which is represented by a vertical arrow. In and/or opposite the direction of the horizontal arrow the deflections w and/or positions and layers of the stitching sites 3 are shown in reference to the rest position of the sewing needle.

Figure 3:
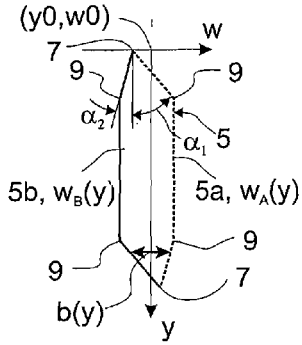
FIG. 3 is a view of an enveloping curve of another sewing pattern.

The enveloping curve 5 comprises two partial curves 5*a*, 5*b*, which during the sewing process in the sewing direction y determine the geometric location of the stitching site 3 and the respective stitching width b(y). The stitch width b(y) can also be shown as a value of the difference of two functions $w_A(y)$ and $w_B(y)$ depending on the respective sewing position y, with the functions $w_A(y)$ and $w_B(y)$ being mathematical descriptions of the partial curves 5*a* and 5*b* (FIG. 3).

The maximum stitch width $b=w_{max}$ of the sewing pattern is smaller than or equal to the maximally possible width of the zigzag-stitch pattern, which e.g., depends on the needle plate, the pressure foot, and the sewing needle. Beginning at one of the tips and/or the apex 7 of the trapezoid, the sewing pattern widens in a first section of the length 11, until the stitch width b reaches the maximum stitch width $w_{max}$. Subsequently a second section follows with a length 11 having stitch width $b=w_{max}$. The end is formed by a third section with a length 13, with here the stitch width b, in reference to the sewing direction, being inversely identical to the first section tapering to a second tip and/or a second apex 7.

Figure 2:
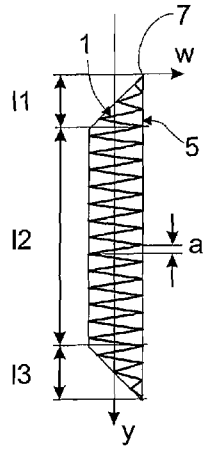
FIG. 2 is a view of the sewing pattern of FIG. 1, however having an enlarged stitch length.

Unlike FIG. 1, the stitch density and/or stitch or transportation length a in the example of FIG. 2 is slightly larger than in FIG. 1. The stitch length a can be selected, adjusted, or determined via an input means of the sewing machine in an incremental or preferably continuous manner. A touch-sensitive monitor may be used as an input means having a graphic user surface for selecting or changing various parameters. Of course, the selection and/or adjustment of parameters, such as e.g., the stitch length a can also occur via buttons, rotary knobs, or push regulators.

When changing the stitch length a, the lengths 11, 12, and 13 of the three sewing pattern sections do not change and thus neither does the overall length 1=11+12+13 of the sewing pattern. The opening angles $\alpha$1 and $\alpha$2 defined by the incline of the partial curves 5*a*, 5*b* in the first section in reference to the sewing direction y also remain unchanged in a change of the stitch length a. The same applies to the third section. In FIG. 1, the opening angle $\alpha$1 is not shown, because only the partial curve 5*b* is provided with an incline in reference to the sewing direction y deviating from 0°.

Optionally, the stitch length a selected by the user may be slightly corrected by the control such that the length 11 of the first section and/or the length 13 of the last section with various stitch widths w amount to an integral multiple of the stitch length a.

Alternatively, in the first and/or the last section an additional end stitch or one or more stitch lengths shortened in reference to the selected stitch length a may be executed in order for the last stitching site 3 being executed exactly at a define location at the end of the respective section.

When sewing a sewing pattern, the machine control may reduce the sewing speed prior to reaching the end of the sewing pattern and stop the sewing process at the last stitching site 3, with the sewing needle remaining pierced in the sewing material. In this position, the pressure foot may automatically or manually be slightly raised and the sewing material be newly aligned, if necessary, so that after the subsequent lowering of the pressure foot another sewing pattern may be created with an appropriately adjusted new sewing direction y', with the two subsequently following sewing patterns contact at least at this joint stitching site 3. Alternatively, the sewing process can also be interrupted after the last stitching site 3 has been reached, the sewing needle be raised, and if necessary the threads cut. If necessary, another sewing pattern can be created off-set in reference to the previous sewing pattern.

Figure 4:
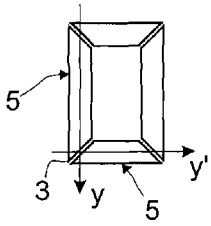
FIG. 4 is a view of enveloping curves of another sewing pattern trapezoidally strung together to form a rectangular frame.

FIGS. 4, 5, 6, 7, 8, 9, 10, and 11 show examples of some combinations of adjoined sewing patterns with linearly widening and/or narrowing beginning and/or end sections, with only the enveloping curves 5, the first two sewing directions y, y', and the last stitching site 3 of the first sewing pattern each being shown. FIG. 4 shows a frame-shaped rectangular pattern, in which the sewing patterns form four legs, each bluntly bordering each other at a miter angle of 45°. At their ends, the legs comprise sections where the leg width asymmetrically tapers to the exterior of the respective leg, so that the last stitching site 3 of each leg is located at its outside (in reference to the rectangular frame). When the adjacent legs shall be located, as e.g., shown in FIG. 4, at a slight distance from each other, the beginning and end section of each leg are reinforced, e.g., by backstitching, and the needle is pierced into the sewing material as the axis for rotating the sewing material at the tip of the respectively subsequent leg. If necessary, the connecting threads between the individual legs can be severed after the completion of the pattern.

Figure 5:
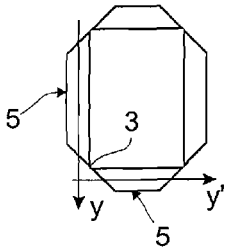
FIG. 5 is a view of an enveloping curve of another rectangular pattern.

In the example of FIG. 5, the legs of the frame meet acutely and the last stitching site 3 is located on the inside of each leg in reference to the form of the frame-shaped pattern. If the adjacent legs contact each other the last stitching site 3 of each leg is equivalent to the first stitching site 3 of the respectively subsequent leg. In order to rotate the sewing material the needle is pierced into the sewing material at this stitching site 3 as the rotary axis.

Figure 6:
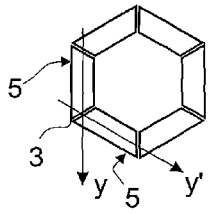
FIG. 6 is a view of an enveloping curve of a hexagonal frame.
Figure 7:
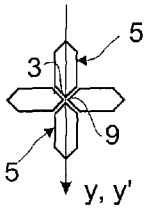
FIG. 7 is a view of an enveloping curve of a cross-shaped pattern with symmetrically tapering enveloping curve ends.
Figure 8:
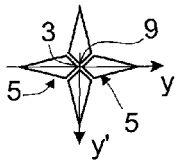
FIG. 8 is a view of enveloping curves of a star-shaped pattern.
Figure 9:
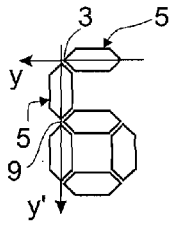
FIG. 9 is a view of enveloping curves formed as similarly shaped segments of a number.

In the example of FIG. 6, six sewing pattern legs form an even hexagon, with the opening angle $\alpha 1$ amounts to 60° at each end of the sewing pattern, and the adjacent legs abut obtusely.

Figure 10:
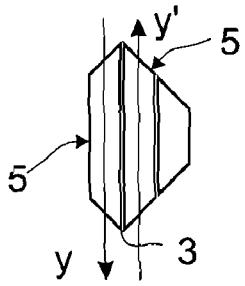
FIG. 10 is a view of enveloping curves of a pattern with trapezoidal sewing patterns longitudinally strung together.
Figure 11:
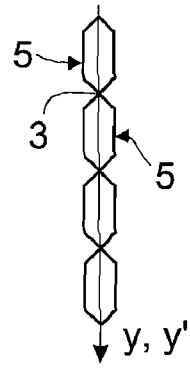
FIG. 11 is a view of enveloping curves of flush strung elements with ends tapering to a tip.

In FIGS. 4, 5, 6, and 11, the legs taper to a sewing pattern, combined from patterns, each symmetrical in their end regions in reference to the leg axis and/or central line of the leg arranged in the sewing direction y. In cross or star-shaped patterns, such as in FIGS. 4 and 5, or in patterns such as shown in FIG. 6 more than two sewing patterns meet at a junction 9 and/or the tips of the sewing patterns group around the junction 9. Such patterns can be prepared in most different ways. For example, subsequent pattern sections with linearly adjacent sewing patterns can be created consecutively. Alternatively, for example originating at the junction 9, all sewing patterns joining there can be created. Any other method is also possible. Patterns may be comprised from individual identical or different sewing patterns. In particular, the length 12 of the straight sewing pattern sections with a constant stitch width $b(y)=w_{max}$ may be different. In the example of FIG. 5, no straight sections are provided and/or their length 12 is equivalent to zero. The opening angle $\alpha 1$ and/or $\alpha 2$ may also be identical or different in the sewing patterns combined to one pattern. In particular, $\alpha 1$ and/or $\alpha 2$ of the first and the last section of a sewing pattern may have identical or different values. It is also possible to sew patterns, in which the legs of adjacent sewing patterns abut each other in the central straight area, as shown in FIG. 10. FIG. 11 shows an exemplary pattern, in which similar sewing patterns with the same sewing direction y are joined to a chain.

Figure 12:
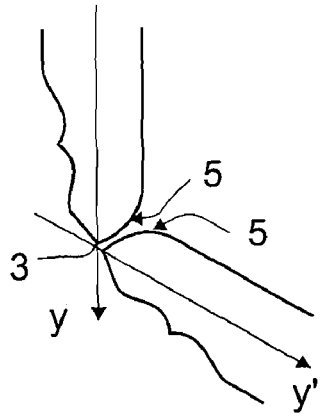
FIG. 12 is a view of enveloping curve sections of two subsequent sewing patterns with individual end and beginning sections.
Figure 13:
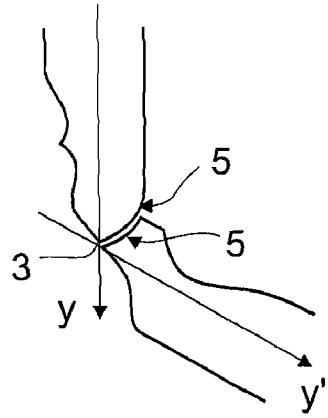
FIG. 13 is a view of enveloping curve sections of two subsequent sewing patterns with adjusted end and beginning sections.

In alternative embodiments, instead of linearly to a tip tapering and/or triangular sewing pattern sections, a different curve progression may also be provided. Here, examples are trapezoidal sections (not shown) or sewing pattern sections with arbitrary shapes, which also comprise curves, such as shown in FIGS. 12 and 13. The enveloping curves 5 of abutting sections of adjacent sewing pattern sections may comprise, as in FIG. 13, complementary forms adjusted to each other, or as in FIG. 12, arbitrary, independent forms.

Preferably, frequently used parameter settings, such as opening angles $\alpha 1$ and $\alpha 2$ amounting to 15°, 30°, 45°, and 60° for linearly changing sewing pattern widths or values of 0, 0.5 and 1 for the relative position of apexes 7 in reference to the maximum width $w_{max}$ of a sewing pattern to be created can be stored as predefined values and selected via a selection menu. These values may then, when needed, be further adjusted or changed, e.g., via rotary knobs or other adjustment means at the sewing machine. The resolution of these adjustment means may be very high, so that the values can be adjusted almost continuously or with a very fine resolution. The selection menu may be provided, e.g., with a tree-structure, with e.g., several selection levels being selectable via tabs. On the first level, e.g., a type of stitch and/or a stitch pattern can be selected, on another level the function "tapering" (if available for the selected stitch type), and on the subsequent level various basic parameter setting. They may then be changed or adjusted via the adjustment means, if necessary. The control can e.g., when options are selected, emphasize compatible options to the respective constellation by different colors and prevent the selection of other options. The same applies to the value sections as well. For example, the available value range for the maximum width $w_{max}$ of a stitch pattern is automatically adjusted depending on the needle plate and the stitch pattern used. In a simple zigzag pattern a wider value range is available as in a more complex stitch pattern. If the user decides in favor of a value not offered for the present constellation he/she can do that, e.g., by operating a correction switch on the touch panel. In this case, e.g., the selection levels with the suggested options to be adjusted are displayed in a blinking fashion.

Of course, the selection and adjustment of options and parameters can also occur in a different manner and the hierarchy of the selection levels may deviate from the one described herein.

The sewing machine control comprises a program memory with the tapering software including all regulations for configuring and executing the tapering. A part of the memory or separate memories are embodied for recording and displaying tapering processes. For example, various tapering patterns may be stored, in which in addition to possible superior pattern data, such as the number of parameters of sewing patterns included for each of the sewing patterns stringed together are saved, such as the element number in the sequence of combined sewing patterns, the sewing direction y (absolute or in reference to the previous sewing direction, shown e.g., by a rotational position of the sewing material), starting point and/or apex 7, end point, opening angle $\alpha 1$, $\alpha 2$, lengths 11 and/or 12 and/or 13 of the first and/or central and/or last sewing pattern section, functions and/or partial curves 5*a*, 5*b*, type of stitch and/or stitch pattern (e.g., as a code, indicating a certain stitch pattern saved), maximum stitch width $w_{max}$ and stitch length a. It is also possible to save for each sewing pattern only the values minimally necessary for characterized in the sewing pattern and to calculate the other values therefrom using predetermined equations.

The storage of sewing patterns and/or patterns combined from sewing patterns may, e.g., occur by entering and/or determining parameter values. Alternatively the recording may also be recorded during a real or virtual reference sewing process. In the latter case, e.g., the needle rod may be decoupled from the primary drive.

For patterns in which one or more parameters are identical in each of the combined sewing patterns, it is sufficient to save them only once and to save each parameter only once for each of the sewing patterns not identical in each sewing pattern.

Examples for saving the pattern in FIG. 4:

Superior pattern specific data:

4=total included sewing patterns

45°, 0°=opening angle ($\alpha 1$, $\alpha 2$) first section

45°, 0°=opening angle ($\alpha 1$, $\alpha 2$) last section

90°=rotational angle of the sewing direction between subsequently following sewing patterns 8 mm=maximum width $w_{max}$ of the sewing pattern 0.8 mm=stitch length a Sewing pattern specific data:

50 mm=section length 12 of the first sewing pattern 30 mm=section length 12 of the second sewing pattern
50 mm=section length 12 of the third sewing pattern
30 mm=section length 12 of the last sewing pattern.

From the data of the opening angle ($\alpha$1, $\alpha$2) for the first and the last section it also follows that the apexes 7 and/or tips of triangular beginning and end sections, seen in the sewing direction y, are located at the right edge of the respective sewing pattern. The lengths 11 and 13 of the sewing pattern result from the opening angles $\alpha$1 and $\alpha$2 of the beginning and end section as well as from the maximum sewing pattern width $w_{max}$.

The stitch length a may be scaled and/or adjusted without changing the lengths 11, 12, 13 of the individual sewing pattern sections.

Saved patterns or sewing patterns may be forwarded to the operating memory and adjusted when necessary. For the reproduction of such sewing patterns on the sewing material each connected sections with the same sewing direction can be automatically sewn without interruption, using the saved data. When a change in the sewing direction is necessary, the sewing speed is reduced, if necessary backstitches for fixing the thread and/or an end stitch is executed, the needle is pierced into the sewing material at the last stitching site 3, and the pressure foot is automatically raised slightly in appropriately equipped sewing machines. The necessary rotational angle for aligning the sewing material to the next sewing direction y' is displayed on the screen. In sewing machines with a sensor for monitoring and/or controlling the material motion this sensor can also be used to monitor and display the exact new alignment of the sewing material.

Subsequently the next sewing pattern is sewn in the respectively same manner, until the pattern is completely reproduced on the sewing material.

In the memory of the sewing machine, rules or parameters may be stored for almost any arbitrary stitching pattern, allowing a scaling and/or enlarging or reducing of these sewing patterns during tapering. Here, during the reduction or enlargement more complex stitch patterns may be simplified or modified, if necessary. The tapering is therefore possible with different stitch patterns.

Instead of a transporter, the relative motion between the sewing material and the stitch formation unit may also occur via other transportation devices, such as e.g., via an embroidery frame.

LIST OF REFERENCE CHARACTERS

1 pressure foot
3 stitching sites
5 enveloping curves
5*a* and 5*b* partial curves
7 apex
9 junction

The invention claimed is:

1. A method to form sewing patterns on a sewing material with a sewing machine, comprising arranging stitch sites along an enveloping curve and changing a stitch width b of a seam during sewing in a sewing direction y according to parameters of the enveloping curve, and changing or adjusting parameters of the enveloping curve independently of at least one other adjustable and/or changeable parameter used for forming the sewing pattern, wherein the at least one other adjustable and/or changeable parameter is a stitch length a, the method further comprising changing the stitch length a without thereby changing values of the parameters of the enveloping curve.

2. A method according to claim 1, wherein one of the parameters of the enveloping curve is a length l of the sewing pattern, the method further comprising changing the length l of the sewing pattern without changing values of the stitch length a.

3. A method according to claim 1, wherein a stitch pattern is selected and preparing the sewing pattern based on said stitch pattern.

4. A method according to claim 1, wherein the parameter values are selected via a selection menu and/or changed via input means.

5. A method according to claim 1, further comprising storing data necessary for reproducing a sewing pattern or a pattern combined from several sewing patterns, suitable for a sewing material.

6. A method according to claim 5, wherein the data is detected and saved during the execution of a real or virtual sewing process.

7. A sewing machine to form sewing patterns on a sewing material, in which stitch sites can be arranged along an enveloping curve, and in which a stitch width b of a seam can be automatically changed during sewing in a sewing direction y according to adjustable and/or changeable parameters of the enveloping curve, the sewing machine comprising a memory in which instructions to form the sewing pattern with the stitch sites arranged along the enveloping curve are saved, and a controller adapted to change or adjust parameters of the enveloping curve independently of at least one other adjustable and/or changeable parameter used for forming the sewing pattern and without changing said at least one other adjustable and/or changeable parameter, wherein the at least one other adjustable and/or changeable parameter is a stitch length a, the method further comprising changing the stitch length a without thereby changing values of the parameters of the enveloping curve.

8. A sewing machine according to claim 7, further comprising input means for changing parameters.

9. A sewing machine according to claim 7, further comprising the memory being capable of storing detected data of sewing patterns and/or patterns.

* * * * *